US005768974A

United States Patent [19]

Ikeda et al.

[11] Patent Number: 5,768,974

[45] Date of Patent: Jun. 23, 1998

[54] SWASH PLATE TYPE COMPRESSOR

[75] Inventors: Hayato Ikeda; Tomoji Tarutani; Masanobu Yokoi; Hiromi Michiyuki; Hirofumi Sato; Yasunori Ueda, all of Aichi-ken, Japan

[73] Assignee: Kabushiki Kaisha Toyoda Jidoshokki Seisakusho, Aichi-ken, Japan

[21] Appl. No.: 620,026

[22] Filed: Mar. 21, 1996

[30] Foreign Application Priority Data

Mar. 22, 1995 [JP] Japan ..... 7-062946

[51] Int. Cl.[6] ..... F01B 3/00

[52] U.S. Cl. ..... 92/71; 417/269; 74/60; 384/125; 384/220

[58] Field of Search ..... 92/12.2, 71; 91/499; 417/269; 74/60; 384/220, 125

[56] References Cited

U.S. PATENT DOCUMENTS

| | | | |
|---|---|---|---|
| 3,817,660 | 6/1974 | Knowles et al. | 417/269 |
| 4,019,342 | 4/1977 | Ohta . | |
| 4,290,345 | 9/1981 | Hiraga et al. . | |
| 4,392,788 | 7/1983 | Nakamura et al. . | |
| 4,454,779 | 6/1984 | Vos | 74/60 |
| 5,013,219 | 5/1991 | Hicks et al. | 417/269 |
| 5,088,897 | 2/1992 | Kawai et al. . | |
| 5,183,340 | 2/1993 | Higginbotham et al. | 384/220 |
| 5,233,913 | 8/1993 | Muirhead | 92/71 |
| 5,433,137 | 7/1995 | Ikeda et al. | 92/71 |
| 5,531,524 | 7/1996 | Brouwer | 384/220 |

FOREIGN PATENT DOCUMENTS

| | | |
|---|---|---|
| 3-61680 | 3/1991 | Japan . |
| 5-195949 | 8/1993 | Japan . |

*Primary Examiner*—Thomas E. Denion
*Attorney, Agent, or Firm*—Woodcock Washburn Kurtz Mackiewicz & Norris LLP

[57] ABSTRACT

A swash plate type compressor includes an improved thrust bearing for axially supporting the swash plate. The bearing is of a composite type, and includes at least two elastically deformable slide bearing elements. The swash plate and the cylinder block each have seat portions, which are of different diameters. The two bearing elements are compressed between the respective seat portions into an elastically deformed conically-shaped state, with the amount of conical deformation depending upon the amount of axial compression that is applied to the bearing by tightening the assembly bolts of the compressor. In operation, one of the conically shaped slide bearing elements is pressed outwardly against the other by centrifugal force as the compressor shaft rotates. During start up and low speed operation of the compressor, this centrifugal force will have minimal effect, and the bearing elements will rotate with respect to each other, keeping internal frictional resistance low. At higher speeds, however, the centrifugal force will both bind the bearing elements to move together as a unit and will impart additional supportive force to the swash plate that will tend to minimize vibration and noise during operation.

15 Claims, 3 Drawing Sheets

SWASH PLATE TYPE COMPRESSOR

BACKGROUND OF THE INVENTION

1. Field of the Invention

This invention relates to a swash plate type refrigerant compressor, such as those which are being used commercially in vehicle air conditioning systems. More specifically, this invention pertains to an improved thrust bearing for use within a compressor that will improve the compressor's performance and efficiency.

2. Description of the Related Technology For the sake of illustrating some of the problems that have led to this invention, reference is made to FIG. 4, which depicts a conventional swash plate type compressor that is disclosed in unexamined Japanese patent application 6463669. The compressor shown in FIG. 4 includes a pair of front and rear cylinder blocks 20A, 20B which are combined together to form a cylinder block assembly. The cylinder block assembly has defined therein a plurality of axial cylinder bores that each receive a reciprocable double-headed piston, and a pair of front and rear housings 14, 15 that are disposed so as to close the opposite axial ends of the cylinder block assembly. The pistons are driven to reciprocate within the respective cylinder bores by a rotary swash plate 22 that is fixedly mounted on a drive shaft 21 which is rotatably supported in the cylinder block assembly.

As is known, cylinder blocks 20A, 20B and housings 14, 15 are assembled together by a plurality of clamp bolts 16 (only one bolt being shown in the drawing). The compressor further includes a pair of front and rear thrust bearings 13, 13 disposed on the drive shaft 21 between the boss portion of the swash plate 22 and the respective front and rear cylinder blocks 20A, 20B. These thrust bearings 13, 13 are held securely in place by a compressive force that is exerted by tightening the bolts 16 in order to clamp together the cylinder blocks 20A, 20B and the housings 13, 14. More specifically, each thrust bearing 13 is held with a radially outer portion of its inner race 13*a* pressed against an annular seat 22*a* that is defined in a boss portion of the swash plate 22, and with a radially inner portion of the outer race 13*b* pressed against a similar annular seat 20*a* that is formed integrally with the adjacent cylinder block 20A or 20B, as shown in the FIG. 4.

When the clamping bolts 16 are tightened the inner and outer races 13*a*, 13*b* that are in pressing contact with the respective seats 20*a*, 22*a* will deform to absorb or take up the axial tightening forces that are created. In other words, take-up or absorption of the tightening allowance is designed to be accomplished by a deformation or deflection of the bearing races. The "tightening allowance" as referred to herein may be defined as an axial distance that the housings 14, 15 are forced to move axially inward relative to the cylinder blocks 20A, 20B by tightening the clamp bolts 16 with a specified amount of torque to fasten the compressor parts together.

Unfortunately, when the tightening allowance in a compressor of the type described above is set to a large amount in order to maximize rigidity of the unit, frictional resistance due to compressive forces within the thrust bearings is increased and power consumption is increased accordingly. This is particularly a problem during start-up and low-speed operation of the compressor.

On the other hand, when the allowance is set to a relatively small amount to reduce internal friction, the swash plate 22 may displace during high-speed operation because of insufficient supporting rigidity, which can lead to production of harmful vibration and noise at high frequencies. The above problem is encountered in not only the above-described type of compressor, but also in compressors of other types that use elastic materials to take up the tightening allowance.

A need exists for a swash plate type compressor that is both power efficient during low speed operation and rigid enough during high speed operation to be protected against harmful noises and vibrations that might otherwise result from displacement of the swash plate in reaction to forces that are created as the refrigerant is compressed.

SUMMARY OF THE INVENTION

Accordingly, it is an object of the invention to provide a swash plate type compressor that is both power efficient during low speed operation and rigid enough during high speed operation to be protected against harmful noises and vibrations that might otherwise result from displacement of the swash plate in reaction to forces that are created as the refrigerant is compressed.

In order to achieve the above and other objects of the invention, an improved swash plate type compressor for a vehicle air conditioning system or the like includes, according to a first aspect of the invention, a block assembly having a swash plate chamber defined therein; a drive shaft; a swash plate mounted for rotation within the swash plate chamber, the swash plate being connected to the drive shaft for rotation therewith; fluid compression structure for compressing a refrigerant, the fluid compression structure being driven by the swash plate; and self-adjusting thrust bearing structure, interposed between the swash plate and the block assembly, for supporting the swash plate against axial displacement during operation, the self-adjusting thrust bearing structure being constructed and arranged to provide a greater amount of resistance to axial displacement of the swash plate during high speed operation of the compressor than during low speed operation of the compressor, whereby the thrust bearing structure both minimizes frictional resistance during low speed operation of the compressor and minimizes the potential of unwanted vibration and noise during high speed operation of the compressor.

According to a second aspect of the invention, a swash plate type compressor includes a cylinder block defining therein a cylinder bore; a housing disposed on each axial end of the cylinder block; a drive shaft supported in the cylinder block by a radial bearing; a swash plate mounted on the drive shaft for rotation therewith; a piston slidably received in the cylinder bore of the cylinder block and driven to reciprocate in the cylinder bore by the rotation of the swash plate; and a thrust bearing disposed between the swash plate and the cylinder block, the thrust bearing being of a composite type including at least two elastically deformable slide bearing elements; the cylinder block and the swash plate having seat portions, respectively, for supporting therebetween the thrust bearing in an elastically deformed state.

According to a third aspect of the invention, a swash plate type compressor includes a pair of front and rear cylinder blocks cooperating to form a cylinder block assembly and defining therein a plurality of cylinder bores; a pair of front and rear housings disposed on axial ends of the cylinder block assembly; a drive shaft supported in the cylinder block assembly by a radial bearing; a swash plate mounted on the drive shaft for rotation therewith; a piston slidably received in each of the cylinder bores of the cylinder block assembly and driven to reciprocate in the associated cylinder bore by the rotation of the swash plate; and a pair of front and rear thrust bearings disposed between the swash-plate and the front and rear cylinder blocks, respectively, each of the thrust bearings being of a composite type including at least two elastically deformable slide bearing elements; the swash plate and one of the front and rear cylinder blocks having seat portions in the form of annular projections with diameters which are different from one another for supporting therebetween one thrust bearing; the one thrust bearing being supported between the annular projection seats in an elastically deformed state.

The above and other objects and features of the invention will become apparent from the following detailed description of the preferred embodiments of the invention in conjunction with the accompanying drawings.

DETAILED DESCRIPTION OF PREFERRED EMBODIMENTS

Figure 1:
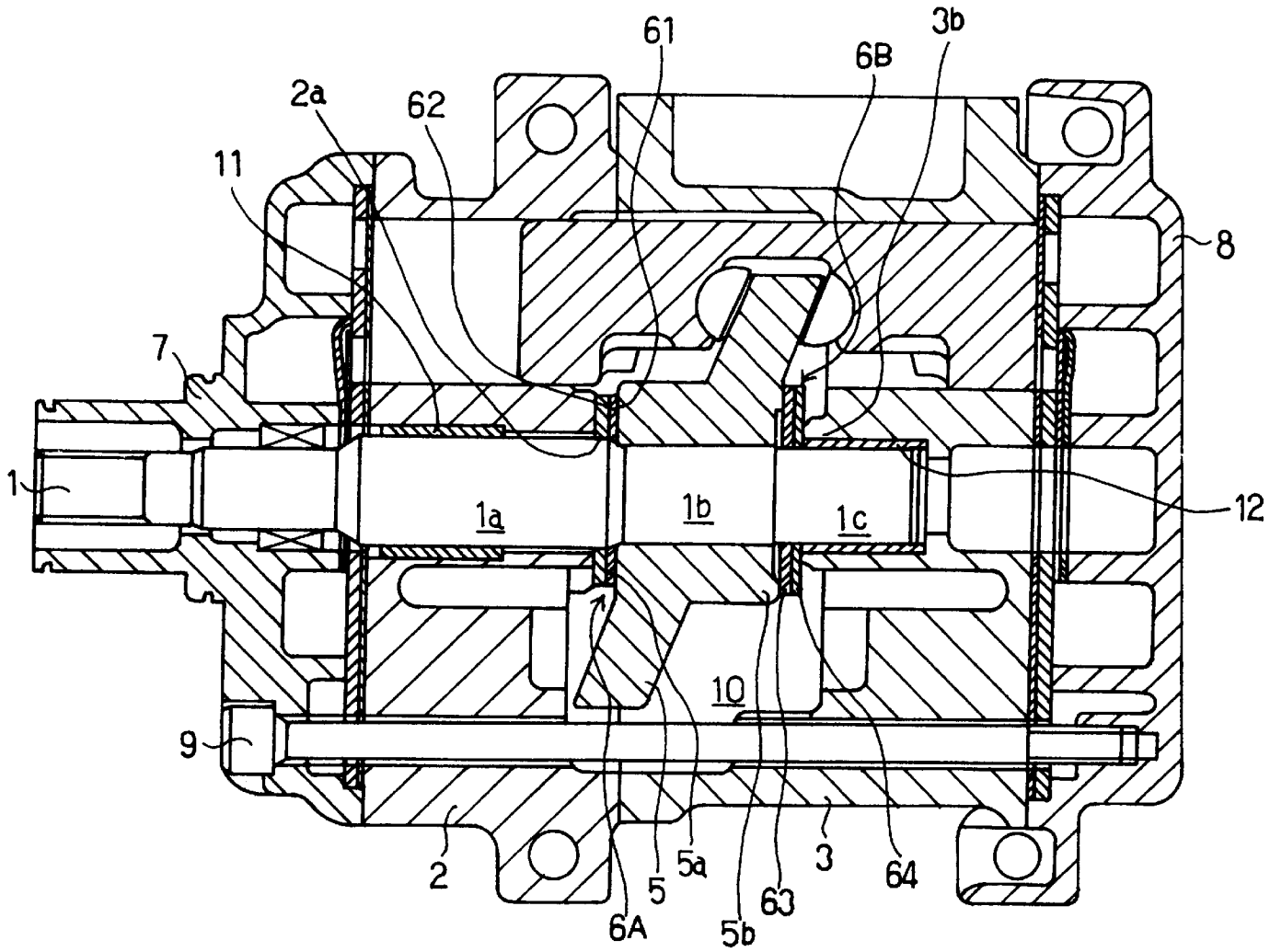
FIG. 1 is an axial cross-sectional view showing a first embodiment of a swash plate type compressor having thrust bearings constructed according to the present invention.
Figure 2:
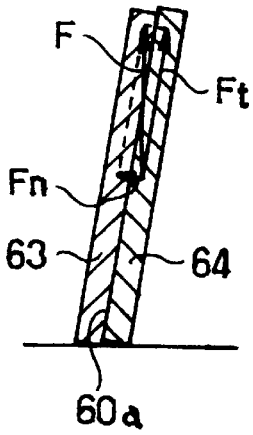
FIG. 2 is an enlarged view showing an upper half of a rear thrust bearing in the compressor of FIG. 1.
Figure 3:
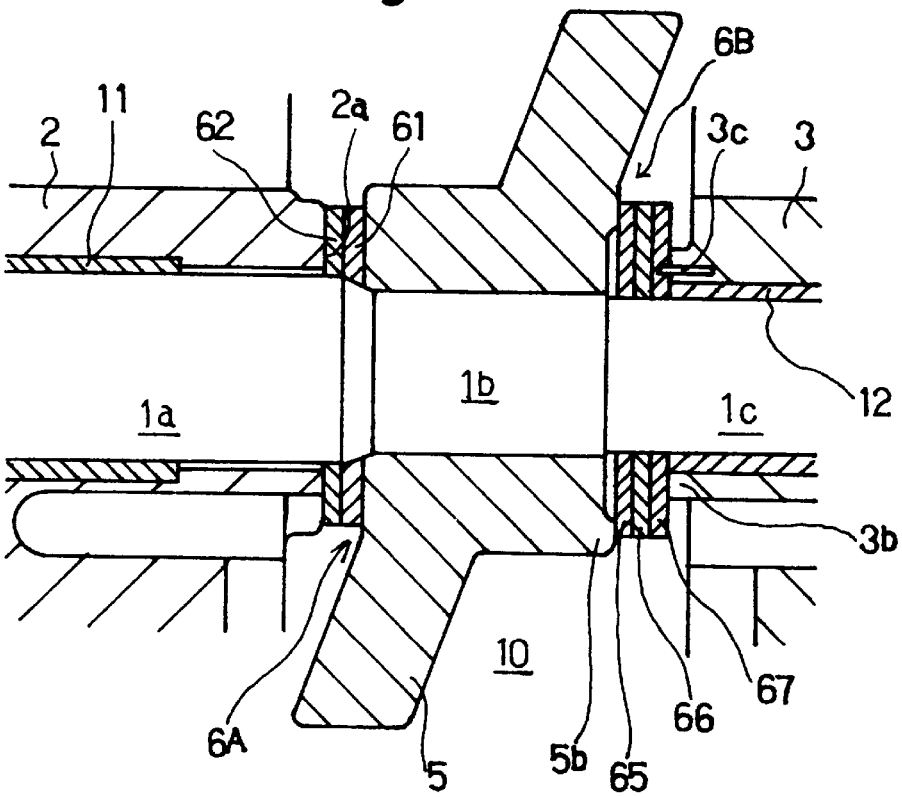
FIG. 3 is an enlarged fragmentary view of a second embodiment of a swash plate type compressor, showing a thrust bearing constructed according to the present invention.
Figure 4:
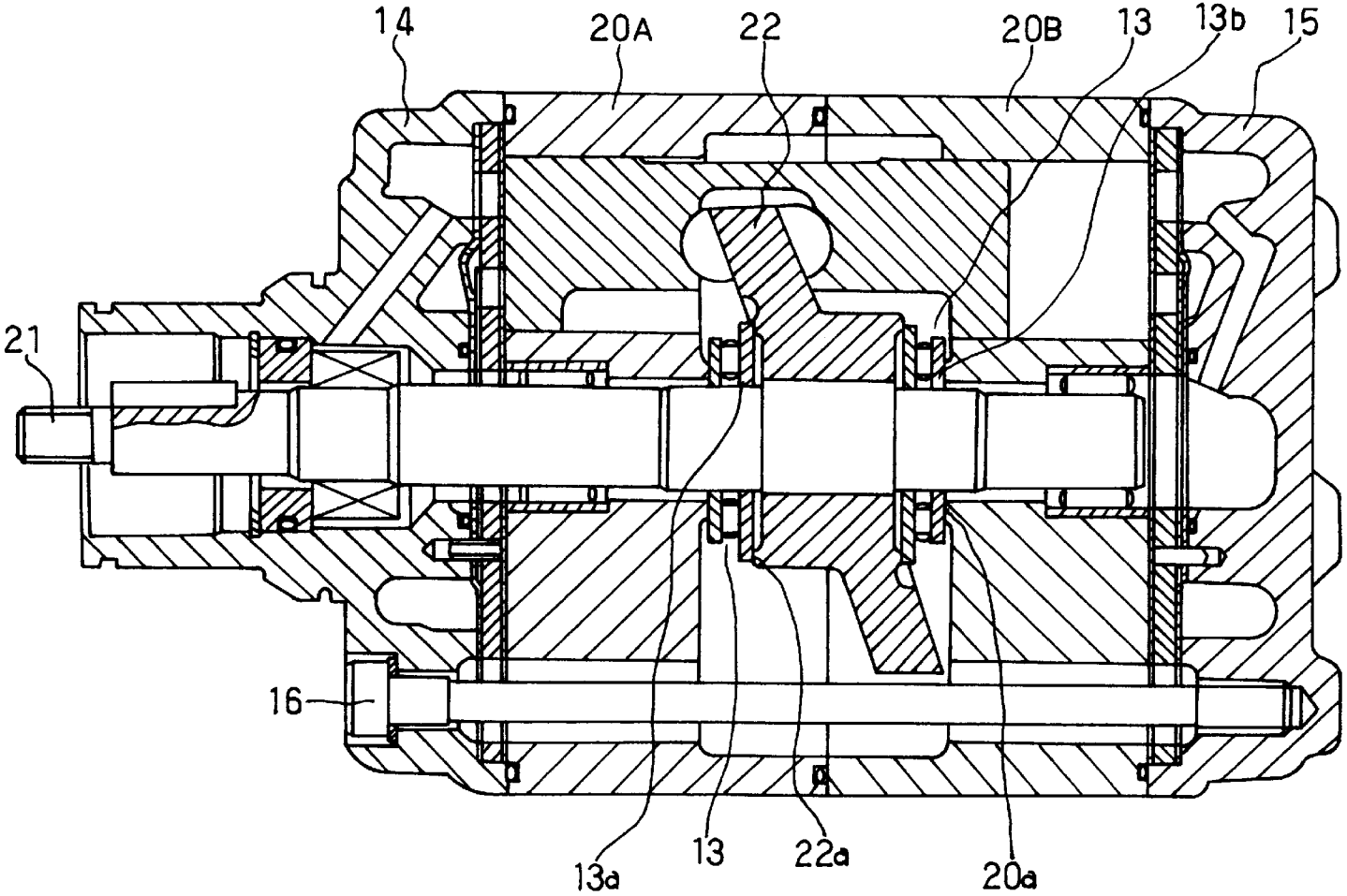
Fig. 4 (PRIOR ART)
FIG. 4 is an axial cross sectional view of a conventional swash plate type compressor.

The following will describe preferred embodiments with reference to FIGS. 1 through 3. Since the arrangement of major parts of the compressor that is shown in FIGS. 1 and 3 is substantially the same as that of the conventional compressor that is depicted in FIG. 4, like elements or members similar to those of the conventional compressor are designated by like numerals and detailed explanation of the arrangement thereof will be omitted in the following description of the preferred embodiments of the invention.

1. The First Embodiment (FIGS. 1 and 2) Referring to FIG. 1, a compressor that is constructed according to this embodiment of the invention includes a drive shaft 1 that is supported in a pair of front and rear cylinder blocks 2, 3, and a swash plate 5 that is mounted for rotation together with the drive shaft 1. The paired cylinder blocks 2, 3 cooperate to form a cylinder block assembly that has, as may be seen in FIG. 1, defined therein a plurality of cylinder bores, each of which receives a reciprocating double-headed piston. The axial opposite ends of the cylinder block assembly are closed by front and rear housings 7, 8.

On the opposite ends of a boss portion of the swash plate 5 are disposed a pair of front and rear thrust bearings 6A, 6B. In the assembled state of the compressor that is shown in FIG. 1, the thrust bearings 6A, 6B are held securely between the boss portion of the swash plate 5 and the respective adjacent cylinder blocks 2, 3 by the compressive tightening force that is exerted by a plurality of clamp bolts 9 which are tightened to clamp the cylinder blocks 2, 3 and the housings 7, 8 together. Reference numeral 10 designates a swash plate chamber, defined by the cylinder blocks 2, 3, in which the swash plate 5 is permitted to rotate.

The drive shaft 1 has a stepped configuration, including a first portion la that is supported in the front cylinder block 2, a second portion 1*b* that is disposed behind the first portion 1*a* and carries thereon the swash plate 5, and a third portion l*c* that is disposed further behind the second portion lb and is supported within the rear housing 3. As may be seen in FIG. 1, the first portion 1*a* is the largest and the third portion 1c is the smallest in diameter of the three drive shaft portions.

The drive shaft 1 is supported radially at its front portion 1*a* by a plain or slide bearing 11 that is disposed in an axial central bore in the front cylinder block 2 and also at its rear portion 1*c* by a similar plain bearing 12 that is inserted in an axial central bore formed in the rear cylinder block.

For the swash plate 5 to safely receive an increasing moment developed as a result of an increase in the discharge pressure of refrigerant gas acting on the piston head, the swash plate is made of a material which is harder than that of the cylinder blocks 2, 3.

The thrust bearings 6A, 6B include inner slide bearing rings 61, 63 that are located on the side adjacent to the boss portion of the swash plate 5, and outer slide bearing rings 62, 64 that are disposed on the side adjacent to the respective cylinder blocks 2, 3. These bearings 6A, 65 are of a composite type. Most preferably, the inner bearing rings 61, 63 are made of SPCC (JIS), or a cold rolled carbon steel, with a fluororesin coating on the surface, and the outer bearing rings 62, 64 are made of SUJ2 (JIS), or a high carbon chromium bearing steel.

The surfaces of the front cylinder block 2 and the boss portion of the swash plate 5 that contact the opposite sides of the thrust bearing 6A are preferably formed as flat seat surfaces 2*a*, 5*a* so as to receive the entire axial surfaces of the bearing rings-61, 62. Thus, thrust bearing 6A is stably held between these seat surfaces 2*a*, 5*a*. For further stability it alternatively be arranged that the outer ring 62 is prevented from rotating relative to the seat surface 2*a*.

Referring to FIGS. 1 and 2, the rear thrust bearing 6B is arranged so as to be elastically deformed in order to absorb any axial load that is produced by tightening of the clamping bolts 9. In the illustrated embodiment, the boss portion of the swash plate 5 is formed at its rear side with an integral annular seat 5*b* that has such a diameter that the inner ring 63 is pressed at its radially outermost portion against the seat 5*b*, and the rear cylinder block 3 is formed at a portion thereof adjacent the swash plate 5 with an integral annular seat 3*b* that has such a diameter that the outer ring 64 is pressed at its radially innermost portion against the seat 3*b*. By providing the annular seats 5*b*, 3*b* with different diameters, the thrust bearing 6B is permitted to be elastically deformed when the clamping bolts 9 are tightened during assembly of the compressor. As will be explained in greater detail below, the axial length that the annular seat 3*b* projects toward the swash plate chamber 10 may be determined depending on the amount of space to be saved by replacement of conventional roller bearings with the plain slide bearings according to the invention. In other words, the design may be such that existing compressors may easily be retrofitted with improved thrust bearings that are constructed according to the invention.

When the cylinder blocks 2, 3 and the housings 7, 8 are clamped together by the clamp bolts 9, the rear thrust bearing 68 is elastically deformed into a cup-like shape, best shown in FIG. 2 (which shows an upper half of the bearing 6B), because the inner and outer rings 63, 64 are pressed from opposite sides by the annular projection seats 5*b*, 3*b* which are formed at radially offset positions. Thus, the tightening allowance is taken up by such elastic deformation of the bearing rings 63, 64.

In this deformed state of the thrust bearing 6B, the facing contact surfaces of its bearing rings 63, 64 define therebetween a conical interface surface or plane 60*a*, as shown in FIG. 2. When the drive shaft 1 is rotating during operation of the compressor, the outer bearing ring 64 will be rotating with the swash plate 5 and will develop a centrifugal force P which is expressed as:

$$F-MR\overline{\omega}^2$$

wherein $\overline{\omega}$ represents the angular velocity of the bearing ring 64, r the distance from the axial center of the drive shaft 1 to the mid point of the conical interface surface or plane 60*a*, and m the mass of the bearing ring 64. As indicated by arrows in FIG. 2, this centrifugal force F has a component Ft which is directed substantially in parallel to the conical plane 60a and a component Fn which is directed substantially perpendicularly with respect to the conical plane 60*a*. Centrifugal force F thus acts to urge the outer bearing ring 64 to be pressed against the inner bearing ring 63. Therefore, the force Fn urging the outer bearing ring 64 against the inner bearing ring 63 is strengthened with as the rotational speed of the drive shaft 1 increases.

When the drive shaft speed is low during a start-up or slow speed operation of the compressor and, therefore, the centrifugal force F and hence its component Fn is small, the two bearing rings 63, 64 tend to rotate relatively to each other as separate bodies. However, when the compressor speed increases and the component Fn becomes stronger, the centrifugal force will tend to press the bearing ring 64 tighter against the ring 63, and the two bearing rings will tend to rotate less relatively to each other. As a certain speed is reached and exceeded, the bearing rings 63, 64 will tend to rotate as an integral unit under the influence of the increased centrifugal force F of the outer ring 64.

It is generally known that a single elastic member made of a certain material with a given thickness, when it is elastically deformed for a given amount, develops a reaction force which is greater than the sum of reaction forces produced by a plurality of separate elastic members made of the same material and each having identical thicknesses the sum of which corresponds the thickness of the above single elastic member.

Therefore, during low speed operation (when the inner and outer bearing rings 63, 64 tend to rotate relatively to each other as separate bodies) the swash plate 5 is axially supported with a relatively low rigidity that corresponds to the sum of reaction forces of the two separate bearing rings 63, 64. Thus, the resistance applied to the swash plate 5 during start up and low speed operation of the compressor is maintained at a relatively low level.

Experiments conducted by the present inventors to find the resulting elastic coefficient K from the elastic coefficients Kl and K2 of the inner and outer bearing rings 63 and 64, respectively, under conditions of the low speed operation have found that K can generally be expressed as:

$$K=1/\{(1/K1)+(1/K2)\}$$

However, during high speed operation (when the inner and outer bearing rings 63, 64 tend to rotate as an integral unit under the influence of the increased centrifugal force F), the swash plate 5 is axially supported with a rigidity which is greater than the above rigidity. Since the swash plate 5 is thus rigidly supported, the compressor can operate with little vibration and noise at a higher speed.

According to the results from experiments conducted by the present inventors to find the resulting elastic coefficient K from the elastic coefficients Kl, K2 of the inner and outer bearing rings 63, 64, respectively, under conditions of the high speed operation, it was revealed that K could be generally expressed as:

$$K=K1+K2$$

It can be thought that the above two equations are derivable from the fact that the elastic coefficient of a general elastic plate member generally increases in proportion to the cube of its thickness.

In a compressor that is constructed according to the embodiment of FIGS. 1 and 2, the inner and outer bearing rings 61, 62 of the front thrust bearing 6A are rotatable relatively to each other, so that the tendency for relative rotation between the inner bearing ring 61 and its adjacent boss portion of the swash plate 5 (and also between the outer bearing ring 62 and the cylinder block 2) is low. Likewise, during low speed operation of the compressor, the bearing rings 63, 64 of the rear thrust bearing 6B will tend not to rotate relative to the adjacent boss portion 5*b* of the swash plate 5 and the seat 3*b* of the cylinder block 3, respectively. Therefore, the seats 2*a*, 3*b* formed on the cylinder blocks, which are made of a relatively soft material, become less susceptible to wear during low speed operation of the compressor.

During high speed operation of the compressor, the inner and outer rings 63, 64 of the rear thrust bearing 6B tend to rotate as an integral unit under the influence of increased centrifugal force of the outer ring 64, so that the outer bearing ring 64 tends to rotate relatively to the seat 3*b* of the rear cylinder block 3. However, because the refrigerant gas introduced from external refrigeration circuit flows first into the swash plate chamber 10 and the flow rate of the gas is the highest in the central region of the swash plate chamber 10 where the thrust bearings are located, the rear thrust bearing 6B can be lubricated successfully by lubricating oil that is contained in the refrigerant gas. Friction between the outer ring bearing 64 and the seat 3*b* of rear cylinder block 3 is lessened by such lubrication and the cylinder block is thus prevented from wearing during high speed operation. Experiments conducted by the inventors using compressors with various dimensions for the seats 2*a*, 3*b*, but under the same condition of the volume of the swash plate chamber 10, showed that the best lubricating results were obtained with compressors having the seat 3*b* projecting about 3 mm or more toward the swash plate chamber 10. Thus, the seat 3*b* of the rear cylinder block 3 can be protected from wear by appropriately forming the seat.

The use of plain slide bearings instead of conventional roller bearings for the thrust bearings 6A, 6B helps to reduce the axial installation space for the bearings. This space reduction in turn makes it possible to construct the compressor to be smaller in the axial dimension. It is noted, however, that the reduction in the axial dimension of the compressor is limited by the projection dimension of the above annular seat 3*b*.

Additionally, since the drive shaft is supported radially at its largest-diameter portion 1*a* by the slide type radial bearing 11, the shaft can be supported stably without being deflected during rotation. Furthermore, the use of the slide bearings 6A, 6B is advantageous in that they are less costly to manufacture than the roller bearings, and less noisy during operation.

2. The Second Embodiment (FIG. 3) Reference is now made to FIG. 3, which shows a second embodiment of a compressor according to the invention, wherein like elements or members similar to those of the first embodiment are designated by like reference numerals throughout the views.

This second embodiment differs from the first embodiment in that the rear composite thrust bearing 6B has three bearing elements, including an axially inner ring 65 that is located on the side adjacent to the boss portion of the swash plate 5, a center slide ring 66 and an axially outer ring 67 that is provided on the side adjacent to the rear cylinder block 3. Most preferably, the inner and outer bearing rings 65, 67 are made of SUJ2 (JIS) or a high carbon chromium bearing steel, while the center slide ring 66 is made of SPCC (JIS), or a cold rolled carbon steel, with fluororesin coating on the surface.

The outer bearing ring 67 is held by a pin 3*c* so as to prevent the ring from rotating relative to the rear cylinder block 3. As a modification of this embodiment, it may be so arranged that the inner bearing ring 65 is also prevented from rotating relative to the swash plate 5.

Since the three rings 65, 66, 67 are separate bodies, any two adjacent rings, i.e. the inner ring 65 and the center ring 66, or the center ring 66 and the outer ring 67, are relatively rotatable. With the cylinder blocks 2, 3 and the housings (not shown) clamped together by the clamp bolts (not shown), these three rings are elastically deformed as in the first embodiment because of the axially offset arrangement of the annular seats 5*b*, 3*b*.

During low speed operation of the compressor, the inner ring 65 and the center ring 66, and the same center ring and the outer bearing ring 67 tend to rotate relatively to each other, as described in detail with reference to the first embodiment, and the three rings 65, 66, 67 axially support the swash plate 5 with a rigidity corresponding to the sum of the reaction forces of the respective rings.

During high speed operation, the center slide ring 56 is pressed tighter against the inner bearing ring 65 under an increased centrifugal force of the latter slide ring. Therefore, these two rings 65, 66 tend to rotate as an integral ring with less relative rotation, while the center ring 66 tends to rotate relatively to the outer bearing ring 67, which is held from rotation. As a result, the swash plate 5 is axially supported with a rigidity which is greater than that merely corresponding to the sum of reaction forces of the respective rings. Thus, the swash plate 5 is be axially supported with a greater rigidity during high speed operation than in a low speed operation of the compressor.

Since the outer bearing ring 67 of this embodiment is held so that it does not rotate relative to the rear cylinder block 3, the seat 3*b* is free from wear. Accordingly, a compressor constructed according to this embodiment of the invention can offer improved operational durability.

It will be obvious to those skilled in the art that other changes and modifications may be made in the invention, in the light of the foregoing teachings, without departing from the scope of the invention defined in the appended claims.

What is claimed is:

1. An improved swash plate type compressor, comprising:

a block assembly having a swash plate chamber defined therein;

a drive shaft;

a swash plate mounted for rotation within said swash plate chamber, said swash plate being connected to said drive shaft for rotation therewith;

fluid compression means for compressing a refrigerant, said fluid compression means being driven by said swash plate; and self-adjusting thrust bearing means, interposed between said swash plate and said block assembly, for supporting said swash plate against axial displacement during operation, said self-adjusting thrust bearing means being of a composite type and including at least two elastically deformable slide bearing elements, said bearing means further being constructed and arranged to provide a greater amount of resistance to axial displacement of said swash plate during high speed operation of the compressor than during low speed operation of the compressor, whereby said thrust bearing means both minimizes frictional resistance during low speed operation of the compressor and minimizes the potential of unwanted vibration and noise during high speed operation of the compressor.

2. A compressor according to claim 1, wherein said self-adjusting thrust bearing means is further for exerting a centrifugally generated force against said swash plate in order to stabilize said swash plate against vibration during high speed operation of the compressor.

3. A swash plate type compressor according to claim 1, wherein one slide bearing element located adjacent the swash plate is coated on the surfaces thereof with flouroresin coating.

4. A swash plate type compressor according to claim 1, further comprising a first seat on said block assembly, and a second seat on said swash plate, said seats having diameters which are different from one another so as to support said thrust bearing at radially offset positions, thereby causing said slide bearing elements to deflect into a conical shape when subjected to an axial compressive load.

5. An improved swash plate type compressor, comprising:

a block assembly having a swash plate chamber defined therein;

a drive shaft;

a swash plate mounted for rotation within said swash plate chamber, said swash plate being connected to said drive shaft for rotation therewith;

fluid compression means for compressing a refrigerant, said fluid compression means being driven by said swash plate; and self-adjusting thrust bearing means, interposed between said swash plate and said block assembly, for supporting said swash plate against axial displacement during operation, said self-adjusting thrust bearing means being of composite type and including at least three elastically deformable slide bearing elements, said bearing means further being constructed and arranged to provide a greater amount of resistance to axial displacement of said swash plate during high speed operation of the compressor than during low speed operation of the compressor, whereby said thrust bearing means both minimizes frictional resistance during low speed operation of the compressor and minimizes the potential of unwanted vibration and noise during high speed operation of the compressor.

6. A swash plate type compressor according to claim 5, wherein a slide bearing element that is located adjacent the block assembly is disposed such that said one slide bearing element is prevented from rotating relative to said adjacent block assembly.

7. A swash plate type compressor comprising:

a cylinder block defining therein a cylinder bore;

a housing disposed on each axial end of said cylinder block;

a drive shaft supported in said cylinder block by a radial bearing;

a swash plate mounted on said drive shaft for rotation therewith;

a piston slidably received in said cylinder bore of said cylinder block and driven to reciprocate in said cylinder bore by the rotation of said swash plate; and a thrust bearing disposed between said swash plate and said cylinder block, said thrust bearing being of a composite type including at least two elastically deformable slide bearing elements;

said cylinder block and said swash plate having seat portions, respectively, for supporting therebetween said thrust bearing in an elastically deformed state.

8. A swash plate type compressor according to claim 7, wherein said thrust bearing of composite type includes at least three elastically deformable slide bearing elements.

9. A swash plate type compressor according to claim 8, wherein one slide bearing element located adjacent the cylinder block is disposed such that said one slide bearing element is prevented from rotating relative to said adjacent cylinder block.

10. A swash plate type compressor according to claim 7, wherein one slide bearing element located adjacent the swash plate is coated on the surfaces thereof with fluororesin coating.

11. A swash plate type compressor according to claim 7, wherein said seats on the cylinder block and the swash plate are provided in the form of annular projections having diameters which are different from one another so as to support said thrust bearing at radially offset positions.

12. A swash plate type compressor comprising:

a pair of front and rear cylinder blocks cooperating to form a cylinder block assembly and defining therein a plurality of cylinder bores;

a pair of front and rear housings disposed on axial ends of said cylinder block assembly;

a drive shaft supported in said cylinder block assembly by a radial bearing;

a swash plate mounted on said drive shaft for rotation therewith;

a piston slidably received in each of said cylinder bores of the cylinder block assembly and driven to reciprocate in the associated cylinder bore by the rotation of said swash plate; and a pair of front and rear thrust bearings disposed between said swash-plate and said front and rear cylinder blocks, respectively, each of said thrust bearings being of a composite type including at least two elastically deformable slide bearing elements;

said swash plate and one of said front and rear cylinder blocks having seat portions in the form of annular projections with diameters which are different from one another for supporting therebetween one thrust bearing;

said one thrust bearing being supported between said annular projection seats in an elastically deformed state.

13. A swash plate type compressor according to claim 12, wherein said one thrust bearing of composite type includes at least three elastically deformable slide bearing elements.

14. A swash plate type compressor according to claim 13, where a slide bearing element of said one thrust bearing that is located adjacent the cylinder block is disposed such that said one slide bearing element is prevented from rotating relative to said adjacent cylinder block.

15. A swash plate type compressor according to claim 12, one slide bearing element of said one thrust bearing located adjacent the swash plate is coated on the surfaces thereof with fluororesin coating.

* * * * *